US006621028B1

(12) United States Patent
Bartok

(10) Patent No.: US 6,621,028 B1
(45) Date of Patent: Sep. 16, 2003

(54) QUIET PUSHBUTTON SWITCH RATCHET MECHANISM

(75) Inventor: Stephen M. Bartok, Rancho Palos Verdes, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 0 days.

(21) Appl. No.: 10/282,480

(22) Filed: Oct. 29, 2002

Related U.S. Application Data

(63) Continuation of application No. 10/242,850, filed on Sep. 13, 2002, now abandoned.

(51) Int. Cl.[7] ..... H01H 13/58; H01H 19/62
(52) U.S. Cl. ..... 200/529; 200/526; 200/527
(58) Field of Search ..... 200/520, 526, 200/527, 528, 529

(56) References Cited

U.S. PATENT DOCUMENTS 4,939,328 A 7/1990 Smith ..... 200/526
5,001,316 A * 3/1991 Salaman ..... 200/527
5,049,709 A * 9/1991 Prickett et al. ..... 200/527
5,132,499 A * 7/1992 Valenzona et al. ..... 200/526
5,145,059 A * 9/1992 Park ..... 200/527
5,226,529 A * 7/1993 Valenzona ..... 200/529
5,847,345 A * 12/1998 Harrison ..... 200/284
6,191,376 B1 2/2001 Bartok ..... 200/529

* cited by examiner

*Primary Examiner*—Michael Friedhofer
(74) *Attorney, Agent, or Firm*—Christie, Parker & Hale, LLP

(57) ABSTRACT

A pushbutton has a body including a barrel and a plunger longitudinally movable in the barrel. A plurality of longitudinally extending teeth on the plunger engage a plurality of longitudinally extending teeth on a rotatable ratchet coaxial with the plunger. The ratchet is spring loaded against the plunger. A rotatable electrical contact cup connected to the ratchet makes or breaks contact with a fixed electrical terminal in the body. The plunger teeth each include a driving face which causes rotation of the ratchet. The driving face has an angle from a normal to the longitudinal direction of the plunger wherein the angle is at least the arctangent of the coefficient of friction between the ratchet teeth and the plunger tooth plus the arctangent of the effective coefficient of friction between electrical contacts in the switch, plus a margin of safety greater than the arctangent of the effective coefficient of friction between other parts of the switch. The angle is up to about 30 degrees.

25 Claims, 6 Drawing Sheets

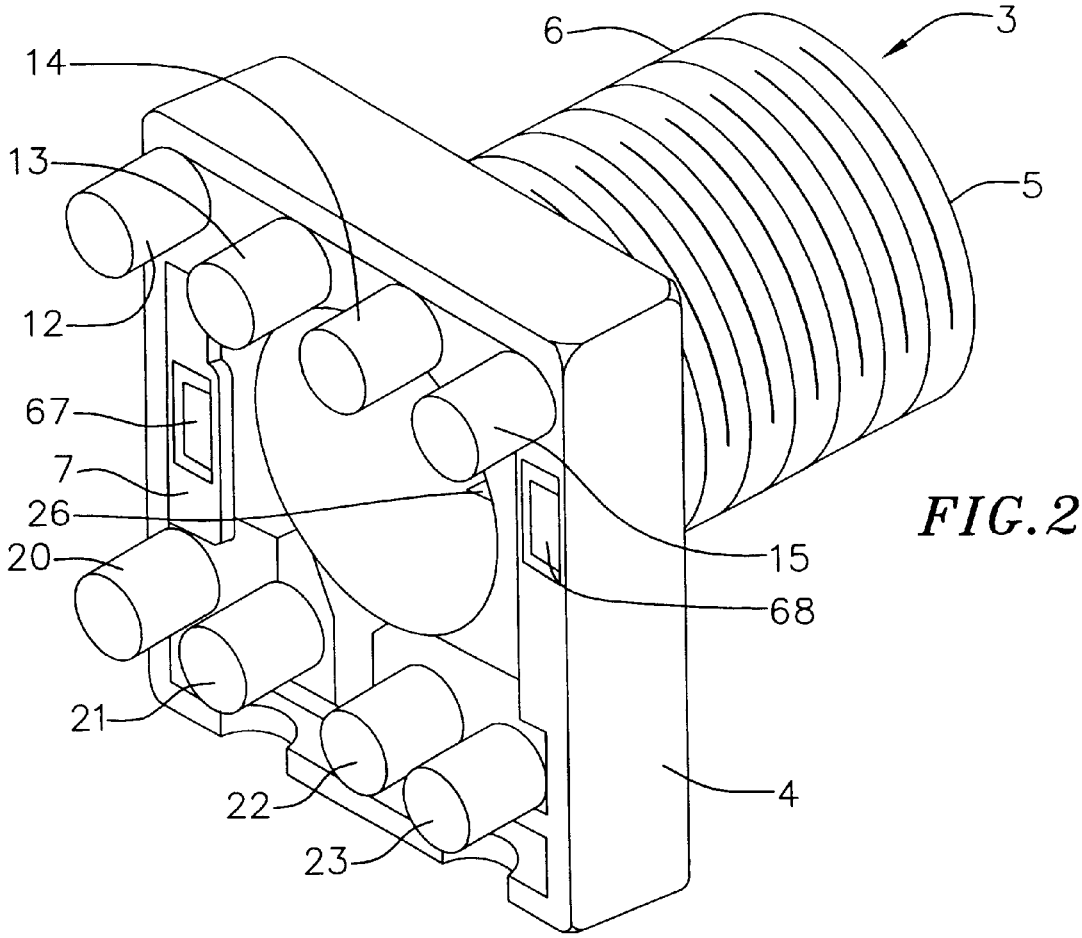
FIG. 2
FIG. 3
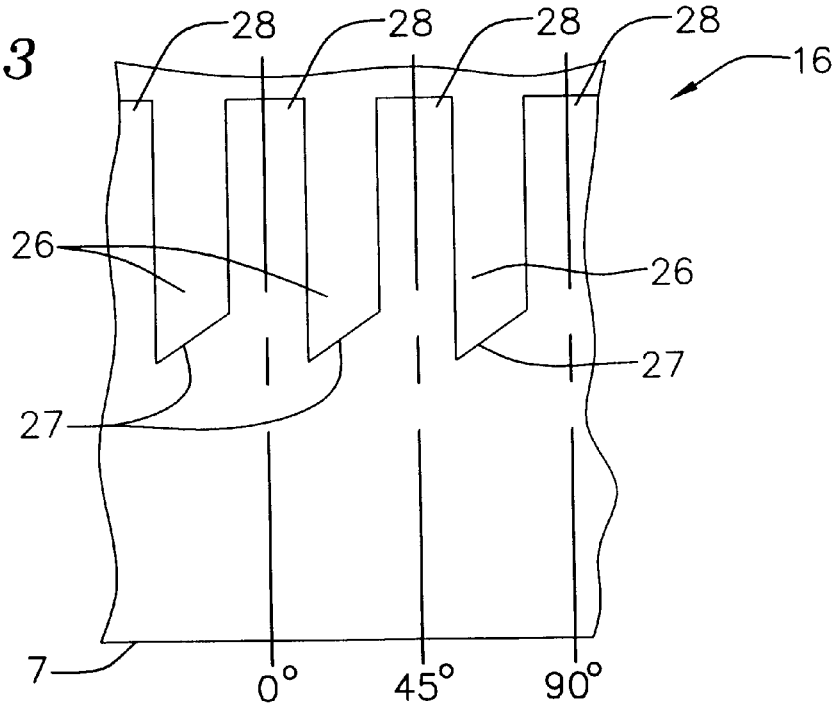

QUIET PUSHBUTTON SWITCH RATCHET MECHANISM

CROSS-REFERENCE TO RELATED APPLICATION(S)

This application is a continuation of application Ser. No. 10/242,850 filed Sept. 13, 2002 now abandoned.

BACKGROUND

The present invention relates to a ratchet mechanism which is particularly useful in pushbutton switches for use in electrical circuits and in particular to pushbutton switches where it is desired that action be "soft", both in sound and tactile feel. In one embodiment this may be a momentary ON switch in which electrical contact is made upon advancing the plunger and contact is broken when the plunger retracts.

A pushbutton switch as described and illustrated in U.S. Pat. No. 6,191,376 is a convenient means for describing the improvements that make the ratchet mechanism used in this switch much quieter and smoother. The subject matter of U.S. Pat. No. 6,191,376 is hereby incorporated by reference. The ratchet mechanism is useful in other pushbutton switches and in other applications where a reciprocating motion is converted to stepwise rotary motion. Such an application is in some ball point pens, for example, where pressing the plunger on the pen advances the writing tip and also rotates the cartridge with the writing tip to distribute wear on the ball.

There has been continued interest in making switches quieter and although some designs have been successful, further improvement is desirable. Some approaches have resulted in adding parts to a switch with consequent cost increase. An example is in U.S. Pat. No. 4,939,328. Better solutions to quieting a switch are desirable.

SUMMARY OF THE INVENTION

In a presently preferred embodiment (exemplified in the description and drawings in a switch), the ratchet mechanism has a plunger having at least one longitudinally extending tooth and constrained to translational motion cooperating with a ratchet member having a plurality of longitudinally extending teeth for engaging a tooth on the plunger and movable both in translation and in rotation. Each tooth on the plunger has a driving face at an angle from a plane normal to the longitudinal direction of the plunger wherein the angle is close to the sum of the arctangent of the coefficient of friction between the ratchet teeth and the plunger tooth and the arctangent of the effective coefficient of friction of other sliding surfaces.

In an exemplary embodiment in a pushbutton switch, there is a body including a barrel and a plunger longitudinally movable in the barrel. A ratchet including a plurality of longitudinally extending camming teeth is coaxial with the plunger. There are a plurality of longitudinally extending camming teeth on the plunger for engagement with camming teeth on the ratchet (one tooth on the plunger being sufficient), each plunger tooth including a driving face having an angle from a normal to the longitudinal direction of the plunger wherein the angle is in the range of from the arctangent of the coefficient of friction between the ratchet teeth and the plunger tooth plus the arctangent of the effective coefficient of friction between other parts moved by depressing the plunger, up to about 30 degrees.

BRIEF DESCRIPTION OF THE DRAWINGS

These and other features and advantages of this invention are more fully set forth in the following description of the presently preferred embodiments when considered in connection with the accompanying drawings in which:

FIG. 2 is a perspective view of a body portion of the switch;

FIG. 3 is a broken away portion of an interior wall of a barrel forming part of the body depicted in FIG. 2, the wall shown flattened out to illustrate splines located therein;

DESCRIPTION

The quiet ratchet is described and illustrated in the context of a pushbutton switch generally similar to the switch described and illustrated in U.S. Pat. No. 6,191,376. The general "switch mechanism" and "switch operation" are effectively the same as in that patent and the way the switch is quieted is described separately in a final section of the description entitled, "How The Switch Is Made Quieter".

Switch Mechanism

Figure 1:
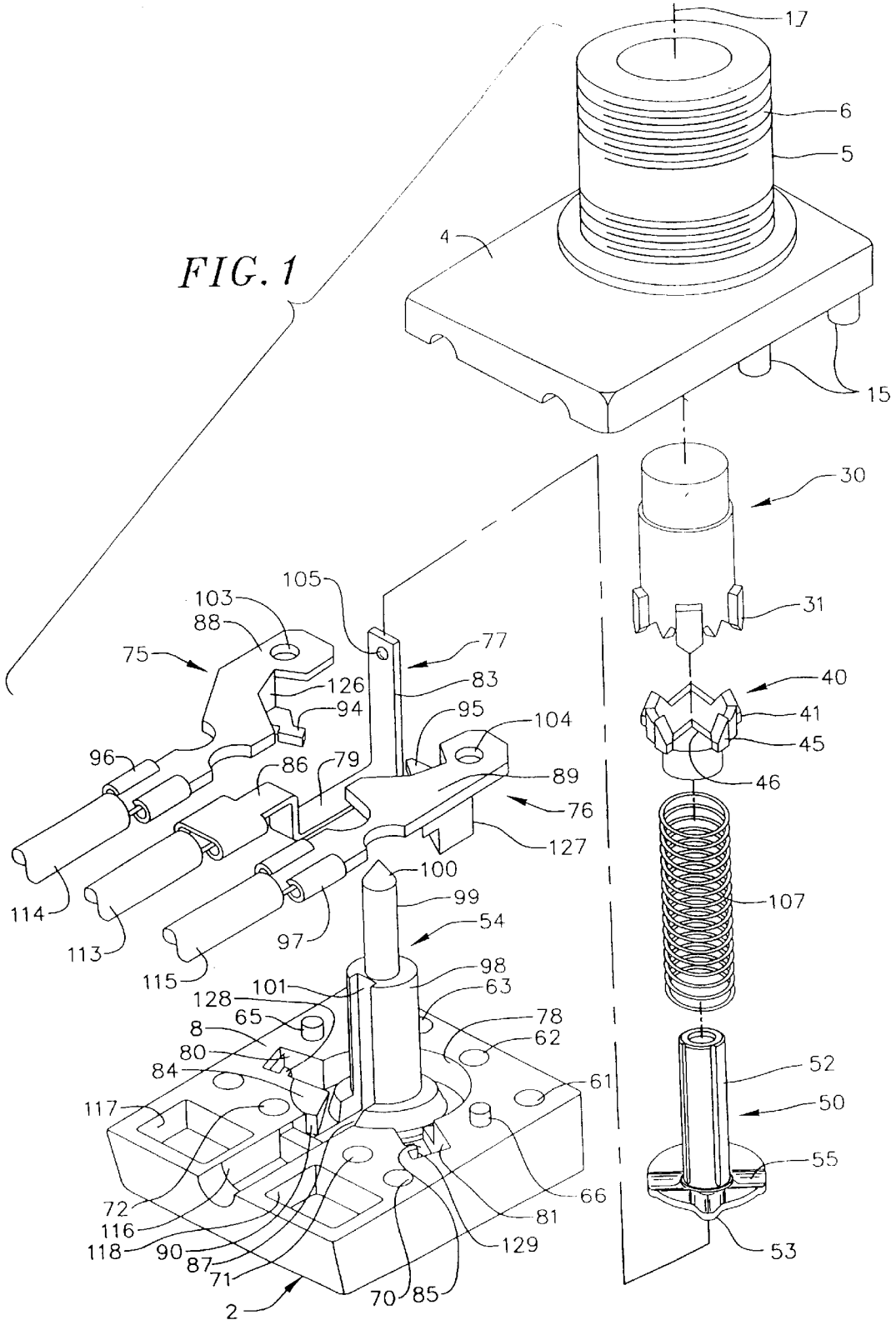
FIG. 1 is an exploded, perspective view of a presently preferred embodiment of pushbutton switch incorporating a quiet ratchet.

FIG. 1 is an exploded view of an exemplary embodiment of the ratchet in the context of a pushbutton switch. The switch includes separable housing portions comprising a cover 2 and a body 3. A plunger 30, ratchet 40 and contact cup 50 are contained within the body.

The body has a planar portion 4 and a barrel 5. The barrel 5 is open at its ends and may or may not have threads 6 on its exterior surface. The planar portion 4 of the body is provided with a mating surface 7. The mating surface 7 has a plurality of spaced pin members, with eight pin members 12–15 and 20–23 being preferably used (FIG. 2). The pin members are disposed in two substantially parallel rows on opposite sides of the barrel and are engagable with recesses correspondingly located in a conforming surface 8 of the cover 2.

A broken away and flattened portion of the interior wall 16 of the barrel is shown in FIG. 3. Splines 26 inside the barrel have spaced apart parallel walls extending longitudinally parallel to the axis 17 of the barrel. Ramps 27 form the ends of the splines 26 closest to the mating surface 7. The ramps have an angle of about 45° from the sides of the splines. The splines are formed by molding the barrel to have a thicker wall in the region of the splines than in the remainder of the barrel. The thinner wall portions between adjacent splines comprise longitudinally extending ways 28. In an exemplary embodiment there are eight splines equally spaced 45° apart, hence eight ways between adjacent splines.

Figure 4:
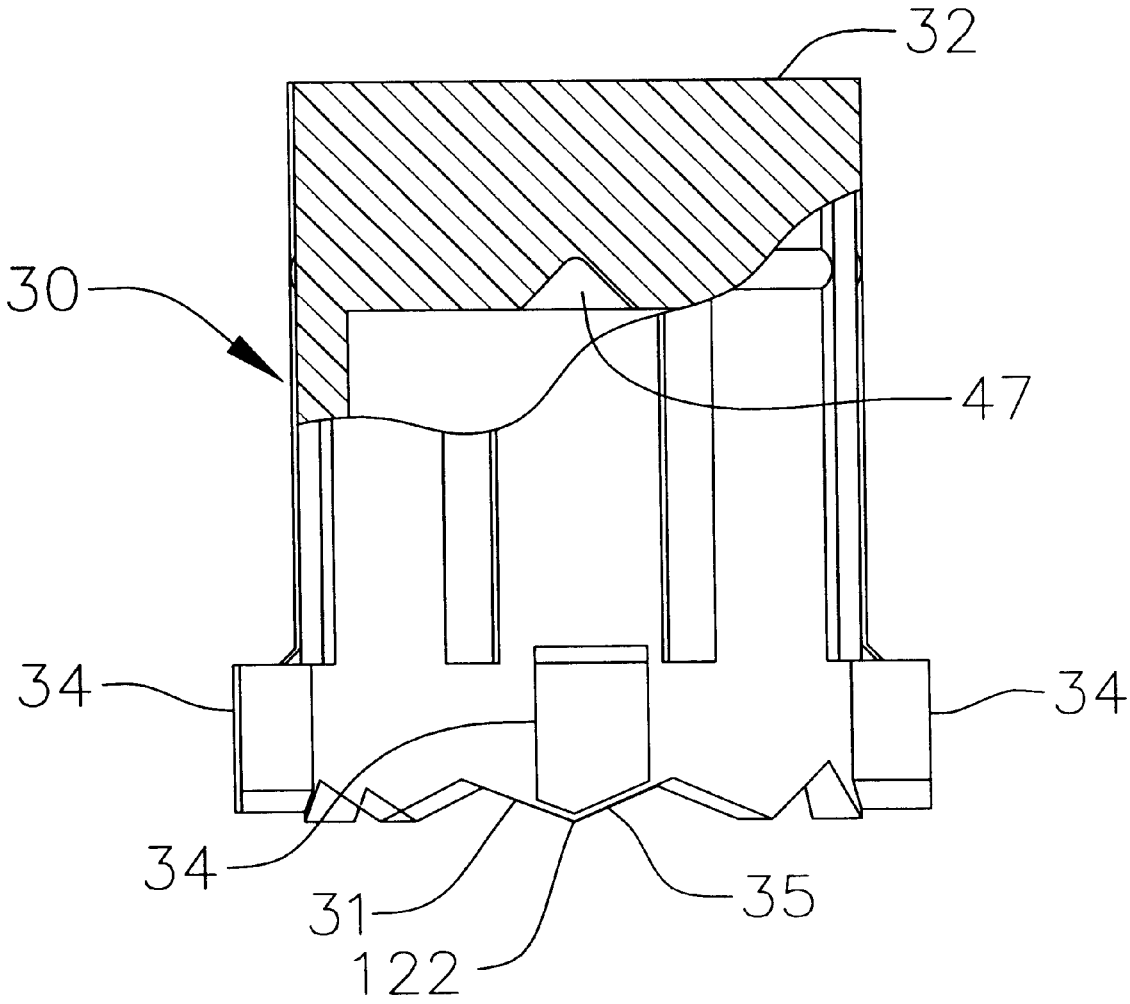
FIG. 4 is a side view, partly cut away in cross section, of a plunger adapted for movement within the body portion of the switch.

The plunger 30 is shown in FIG. 4. The plunger is constrained to translation, i.e., axial sliding movement within the barrel. The plunger is tubular in form, having an open end portion 31 and a closed end portion 32. When inserted in the body, the closed end portion 32 projects out of the barrel providing a primary actuating button for operation of the switch. The open end portion 31 has a plurality of circumferentially spaced lugs 34, with four lugs being employed in this preferred embodiment. The lugs are spaced 90° apart projecting generally radially outwardly. When the plunger is within the barrel, the lugs ride in the ways 28 and engage the splines 26. The length of the splines is sufficient to maintain engagement with the lugs during the full actuation of the switch, preventing angular rotation of the plunger 30 relative to the barrel.

The open end portion additionally comprises a plurality of evenly spaced camming teeth 35. The camming teeth form a sawtooth annular ring on the end of the plunger. This preferred embodiment utilizes eight camming teeth 35, four of which include end portions of the lugs. The camming teeth are asymmetrical as described below after other parts of the switch are described.

Figure 5:
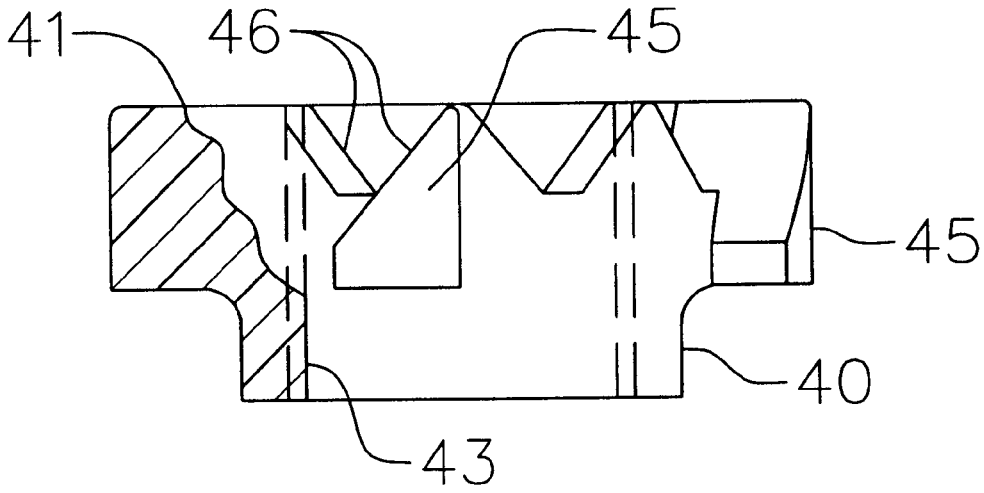
FIG. 5 is a side view, partly cut away in cross section of a ratchet adapted for working with the plunger shown in FIG. 4.
Figure 6:
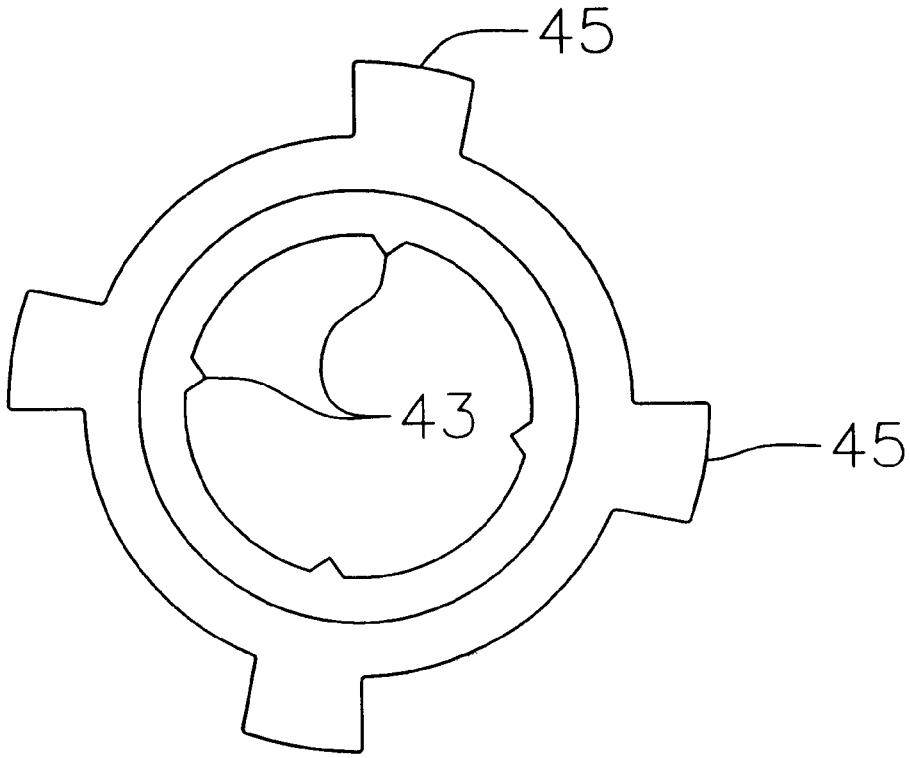
FIG. 6 is an end view of the ratchet of FIG. 5.

The ratchet mechanism of the switch comprises the spline ramps 27 and the ways 28 of the barrel, the lugs 34 on the plunger and 45 on the ratchet and camming teeth 35 of the plunger and 46 on ratchet 40. Referring to FIGS. 5 and 6, the ratchet 40 has a generally cylindrical lower portion with a cylindrical longitudinal passage. A plurality of elongated longitudinal V-shaped ribs 43 are formed in the interior wall of the ratchet, four ribs being presently preferred, spaced 90° apart. The upper end of the ratchet has a plurality of circumferentially spaced dogs 45, with four dogs 45 being preferred in this embodiment to correspond to half the number of ways in the barrel. The dogs 45 are spaced 90° apart around the ratchet 40, projecting radially outwardly therefrom. When the ratchet is inserted into the barrel, the dogs first engage the ramps 27 on the ends of the splines and then enter the ways 28. The splines 26 are of a length to permit disengagement from the dogs 45 during actuation of the switch, permitting angular rotation of the ratchet relative to the barrel and the plunger.

The upper end portion 41 of the ratchet has a plurality of evenly spaced camming teeth 46, distributed around the exterior surface of the ratchet. The ratchet camming teeth face towards and cooperate with the plunger camming teeth 35. The camming teeth 35 in this embodiment of the ratchet may be symmetrical or asymmetrical as long as they allow the ratchet motion to follow the plunger teeth.

The contact cup is made of a conductive material and is adapted for rotation to make and break electrical connections with a left terminal 75 and a right terminal 76. The contact cup is generally tubular in shape having one end open and the other end partially closed. The partially open end has a circular opening 51 which provides a bearing surface for a central post stud 54. The central post stud extends from the cover 2 into the barrel along the barrel axis 17. The open end of the contact cup has a circular flange 55 extending radially outward from the circumference thereof. Four equally spaced areas on the flange are formed downwardly in a curved bulge referred to as contact tabs 53. In this embodiment, four generally radially extending tabs are evenly spaced around the open end. During switch operation, the contact tabs engage in alternate wiping contact with a portion of the left and right terminals 75, 76. The contact tabs have curved edges on the bulges to prevent galling the terminals when making such contact with the terminals.

The contact cup is additionally provided with a plurality of elongated longitudinal V-shaped grooves 52 on its external surface. The grooves begin at the partially closed end and extend along the body of the cup nearly the full distance to the open end. The partially closed end of the cup and the portion of its length containing the grooves 52 are inserted and keyed with a sliding fit into the ratchet 40. The grooves are of the same number and mate with the ribs 43 within the ratchet. The mating of the ribs and grooves causes the ratchet and contact cup to rotate as a single unit when the switch is actuated. The ratchet is free to slide longitudinally along the contact cup. The ribs and grooves are aligned such that the contact tabs 53 are displaced approximately 22.5° from the ratchet dogs 45.

The switch cover 2 is provided with a plurality of recesses in its conforming surface 8. Eight holes 61–64 and 70–73 are in two substantially parallel rows on opposite sides of the central post stud 54. The holes mate with pin members 12–15 and 20–23 located in the mating surface 7 of the switch body (FIG. 2) when the cover and body are assembled together. The cover and the body are preferably held together by means of an interference fit between the holes and the pin members. An approximately circular recess or cavity 78 extends into the cover with its center aligned with the barrel axis 17. The central post stud 54 extends perpendicularly along the center of this recess or cavity. Two terminal recesses 80, 81 open into the circular recess or cavity 78.

The bottom of the circular recess or cavity is planar and has a center channel 87, two terminal pockets or pads 84, 85, two main camming ramps 90, 93 located thereon. The terminal recesses 80, 81 are located on either side of a center channel 82. The ramps slope upward from the bottom of the circular recess or cavity 78 in a clockwise direction when viewed from above. One of the ramps 90, 93 is located before each of the terminal pockets 84, 85, moving in a clockwise direction as viewed from above. The ramps 90, 93 provide a smooth transition from the bottom of the circular recess or cavity 78 to a height at the level that of the terminal contact surfaces.

Two terminal locating posts 65, 66 extend away from the conforming surface 8 of the cover, the posts being preferably located between the parallel rows of holes. Two recesses 67, 68 (FIG. 2) are located in the mating surface 7 of the body to receive the locating posts.

The left and right terminals 75, 76 each include a mounting portion 88, 89, a planar contact portion 94, 95, a crimped end portion 96, 97 and a locating hole 103, 104. The terminals are mounted on the cover and held in place by the mating surface of the body, the mating surface 7 being recessed to conform to the shape of the terminals. The terminals are secured in position by the locating posts 65, 66 which pass through the locating holes 103, 104. The terminals are additionally secured in position by adjacent vertical members 126, 127 of the contact portions 94, 95 which seat in the terminal recesses 80, 81. The vertical members 126, 127 are held position-captive by ribs 128, 129 which are integrally molded with the cover. When seated, the contact portions 94, 95 are located in a plane slightly above the ramp tops, and are parallel to the bottom of the circular recess or cavity 78.

The central post stud 54 comprises a lower center post 98, and an upper guide post 99. The lower center post has a channel relief 101. The upper guide post is provided with a conical tip 100 which mates with a conical recess 47 in the interior of the plunger (FIG. 4). The conical tip acts as a stop when the plunger 30 is depressed all the way to the bottom. This prevents deformation damage to the contact cup or terminals. Engagement of the conical tip with the mating conical recess in the interior of the plunger also prevents the upper guide post from deflecting to one side when the plunger is depressed all the way to the bottom.

A common terminal 77 is additionally located on the cover 2. The common terminal 77 has a substantially U-shaped portion 79, a right-angled finger portion 83 and a crimped end portion 86. The end of the finger portion is provided with a raised bulge 105, which at all times maintains electrical contact with the inside of the contact cup 50. The U-shaped portion 79 seats in the center channel 87 while the right-angled portion 83 is positioned in the channel relief 101.

The crimped end portions 86, 96 and 97 of the terminals are attachable to conventional electrical conductors 113, 114 and 115, respectively, to connect the switch to a common lead and two portions of an external electrical circuit. Recesses 116, 117 and 118 are located in the conforming surface 8 of the cover to provide clearance for the crimped end portions 86, 96 and 97.

Figure 7:
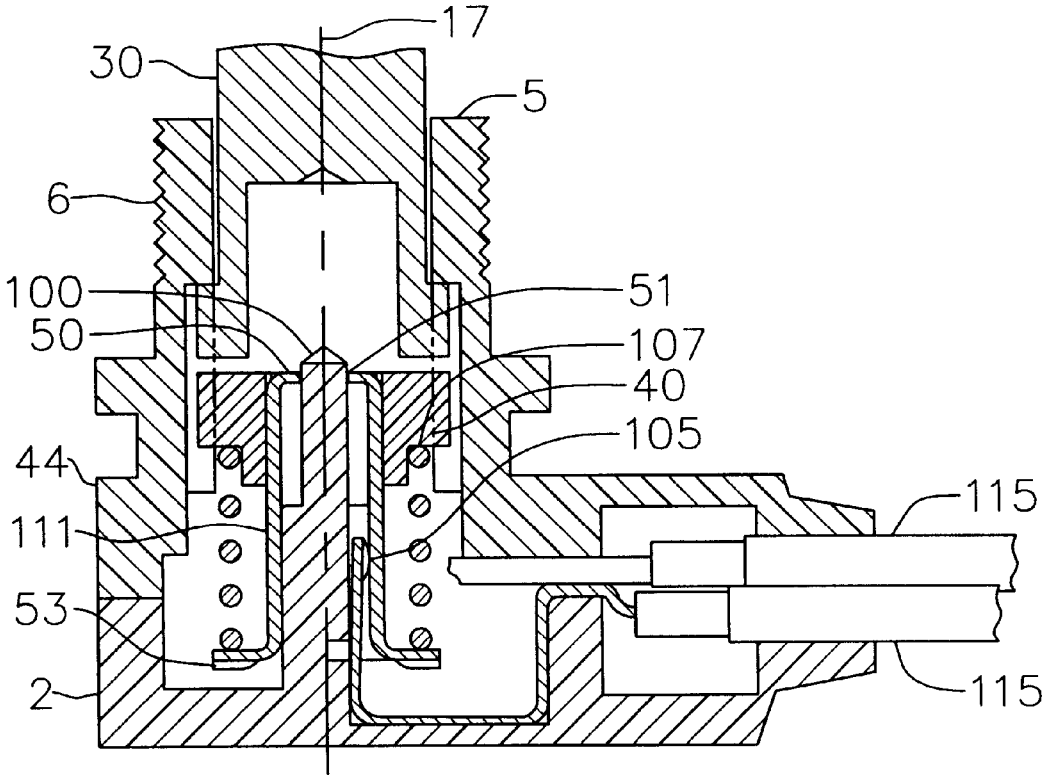
FIG. 7 is a sectional view of the switch shown in FIG. 1.
Figure 8:
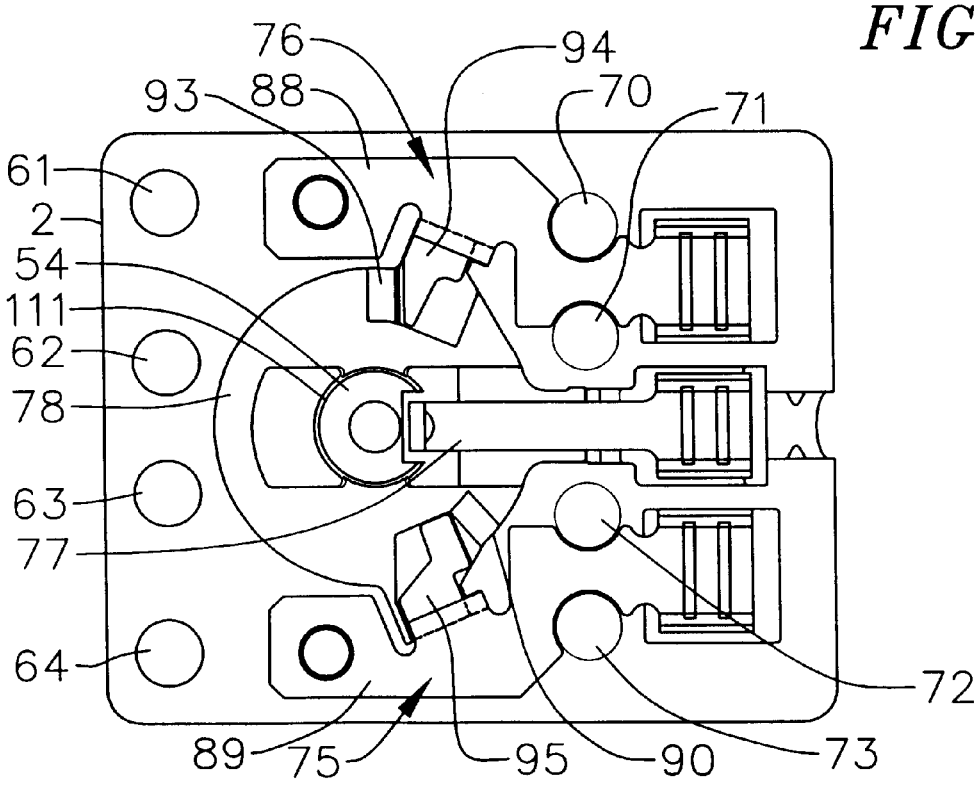
FIG. 8 is a top plan view of the cover portion of the switch.

FIG. 7 shows a sectional view of the switch. When assembled, the plunger 30 is inserted in the barrel 5, the ratchet 40 is positioned opposite and coaxial with the plunger, the contact cup 50 is inserted through the ratchet 40, and the cup opening 51 is positioned so that the contact tip 100 extends therethrough. A helical spring 107 is disposed around the outside of the contact cup and seats between the radial flange 55 and the end portion of the ratchet. The spring 107 provides a continual force against the flange, biasing one of the tabs 53 toward one of the left or right terminals 75, 76. The spring also biases the ratchet towards the plunger for engaging the ratchet teeth with the plunger teeth and drives the rotary motion of the ratchet and cup.

The left and right contact portions 95, 94 extend generally radially toward the axis 17 of the barrel in directions that are 135° apart. The four tabs on the contact cup are 90° apart. Thus, one of the tabs can be in contact with one of the contact portions and the other three tabs are necessarily out of contact with the other contact portion. With such contact between the cup and a contact portion, the switch is in an ON position with an electrical connection path between one external electrical conductor 114 or 115 and a central conductor 113. The contact portions are sufficiently small that when the contact cup (and the ratchet) has rotated 22½° from a position where one of the tabs is in contact with a contact portion, none of the tabs are in electrical contact and the switch is in an OFF position. Upon rotation an additional 22½° another tab comes into electrical contact with the other of the contact portions and the switch is again in an ON position.

In the illustrated embodiment, the camming teeth 35 on the plunger are asymmetrical to provide approximately 22½° rotation of the ratchet and cup upon advance of the plunger toward the ratchet. Another 22½° rotation of the ratchet and cup upon retraction of the plunger, e.g. when finger pressure is released occurs due to engagement of the ratchet lugs against the angled faces on the body splines.

Switch Operation

When the plunger of the switch is not depressed, all of the contact tabs 53 are located circumferentially away from (i.e., not in contact with) either of the planar contact portions 94, 95 and the switch is OFF. The spring 107 is biasing the ratchet 40 towards the plunger 30 as far as it will go, engaging the ratchet dogs 45 within the ways 28. The ratchet also transfers the spring force to the plunger 30 and has moved the plunger into the barrel 5 to its fullest extent, the plunger lugs 34 engaging the walls of the splines adjacent to the ways 28. The plunger camming teeth 35 and the ratchet camming teeth 46 are in partial engagement, being about 22½° out of full alignment, apex to valley.

Switch actuation begins with a downstroke of the plunger 30. During the beginning and the middle of the downstroke, the plunger and the ratchet move down the barrel, compressing the spring. Near the end of the downstroke, the ratchet dogs 45 travel beyond the end of the splines 26 permitting partial rotation of the ratchet 40. The force of the primary spring 107 acting against the force of the downstroke causes the ratchet to rotate until the plunger camming teeth 35 and the ratchet camming teeth 46 are fully engaged. The amount of this rotation of the ratchet is 22½° clockwise. The rotation of the ratchet is transferred to the contact cup 50 causing rotation of the contact tabs 53 about the lower center post 98. The terminal planar contact portions 94, 95 are located so that this amount of rotation by the tabs brings one of the tabs into electrical contact with the contact portion 94, 95 of one of the terminals. Thus, the switch is ON.

At the end of a downstroke to at least the point where the ratchet clicks into full engagement of the teeth, release of pressure on the plunger initiates an upstroke, permitting the spring 107 to return the ratchet and the plunger to their initial longitudinal positions. During the upstroke of the plunger, the ratchet dogs 45, now rotated 22½° from their initial position, are no longer aligned with the ways 28 from which they emerged. As the ratchet moves up, the ratchet dogs engage the spline ramps 27 and move along their length clockwise. The clockwise movement of the dogs rotates the ratchet and the contact cup another 22½°. Each ratchet dog enters the way 28 clockwise from that from which it emerged, moving up its length as far as it can go. In the final position of the ratchet, the ratchet camming teeth are partially engaged with the plunger camming teeth, just as they were before the downstroke.

As the plunger is depressed, the ratchet is also pushed downwardly against the spring. When the ratchet passes the ends of the splines, it is free to rotate and the sloping ramp of the leading face causes it to rotate to a position with the apex of the ratchet tooth in the valley between adjacent plunger teeth. In other words, the teeth on the ratchet and plunger are fully engaged even though the teeth do not have the same angles on the surfaces. As previously described, this brings a tab into electrical contact with a terminal and the switch is in its ON position.

Equal angles on the surfaces of the teeth of the ratchet are not necessary. For example in the illustrated embodiment, the symmetrical ratchet teeth have an included tip or apex angle of 90° and each face of the tooth has an angle of 45° to a plane normal to the axis.

When the plunger retracts, the ratchet follows it upwardly as driven by the spring. When the ratchet dogs encounter the ramps on the ends of the splines, the ratchet cannot continue to follow the plunger in the same rotational orientation. Instead it is caused by force of the spring and engagement of the lugs and ramps to rotate. This rotation continues until the lugs can enter the next way between splines and the ratchet teeth move back into engagement with teeth on the plunger. The rotation of the ratchet is limited by the splines, however, and it comes to rest with the apex of a ratchet tooth at a location on the leading ramp face of the next plunger tooth.

The asymmetrical teeth on the plunger and other parts of the assembly are positioned so that the location on the leading face where the apex of the ratchet tooth comes to rest is equidistant from each valley at the ends of that plunger tooth. In other words, about 22½° from the valley at the end of the leading face and about 22½° from the valley at the start of the previous trailing face. This can be accomplished with any number of angular relationships between the lugs, dogs, camming teeth and terminal contacts.

The angular motion of the ratchet of 22½° is transferred to the tabs 53 on the cup. This rotation moves the tab on the terminal planar contact portion, off of the contact and the switch is now OFF. The angle of rotation is not enough to bring another tab into contact with the other terminal contact portion, since the two contact portions are, in effect, 45° apart. That would occur upon the next downstroke of the plunger.

Successive plunger strokes results in a tab contacting alternately the left and right terminal planar contact portions 94, 95, completing a circuit through the switch between the common terminal 77 and alternately the left and right terminals 75, 76. For a momentary ON switch, the left and right terminals are electrically connected together.

Thus, the switch is normally in its OFF position when the plunger is retracted. The ratchet teeth are not aligned with the plunger teeth since rotation of the ratchet is inhibited by engagement of its lugs with the splines. Upon depressing the plunger, the ratchet moves downwardly and when its lugs reach the lower end of the splines, it clicks 22½° to a rotational position where the ratchet teeth are aligned and in full engagement with the plunger teeth. This is a momentary ON position, since as soon as the plunger moves upwardly, the ramps on the ends of the splines cause an additional 22½° increment of rotation to take the switch to its OFF position again.

The way the plunger lugs, ratchet dogs, splines, end ramps on the splines and teeth on the plunger and ratchet interact to cause rotation of the ratchet upon depressing the plunger is described generally in U.S. Pat. No. 6,191,376.

Although described with four electrical contact tabs, four ratchet dogs, eight ratchet teeth, eight plunger teeth, four plunger lugs and eight splines, other numbers may be employed in other embodiments of pushbutton switch. The number of teeth on the plunger and ratchet is 360°/x where x is the circumferential angle of one full tooth (in this case x=45° and the number of teeth n is eight). For a momentary ON switch, the number of splines in the body is also n. The number of tabs is n/2 and the terminal contact portions are, in effect, spaced apart by an angle x, but displaced x/2 from the position of the tabs when the ratchet dogs are in ways in the body so that the switch moves from OFF to ON to OFF in one complete stroke of the plunger. In other embodiments, the number of teeth n may be three or five, for example, when greater or less angular rotation is desired for each depression of the plunger. The angles and numbers of splines, etc., change commensurately.

If one desires a switch with a cycle of ON upon one stroke of the plunger and OFF on the next stroke, the number of splines is made equal to the number of tabs and the terminal contact portions are located accordingly. A similar arrangement can be used where successive strokes of the plunger alternate contact between the left and right terminals.

How The Switch Is Made Quieter

Generally speaking, the switch is made quieter than prior switches having a structure as described above, by reducing the angle of the teeth on the plunger. The angle of the driving face of the plunger teeth is considered as the angle from a normal to the longitudinal direction of the plunger. Stated otherwise, it is the complement of the angle between the driving face and the longitudinal direction. The minimum angle of the driving face is such that the tangent of the angle is more than the coefficient of friction between the ratchet teeth and the plunger teeth plus the coefficients of friction between other mechanisms moved by the ratchet, for example, friction between electrical contacts in the switch. Preferably, the principal sources of friction are considered to determine a minimum angle for the driving face, and then a margin of safety is added to account for additional friction not readily calculated and for increases in friction over the life of the mechanism.

Figure 9:
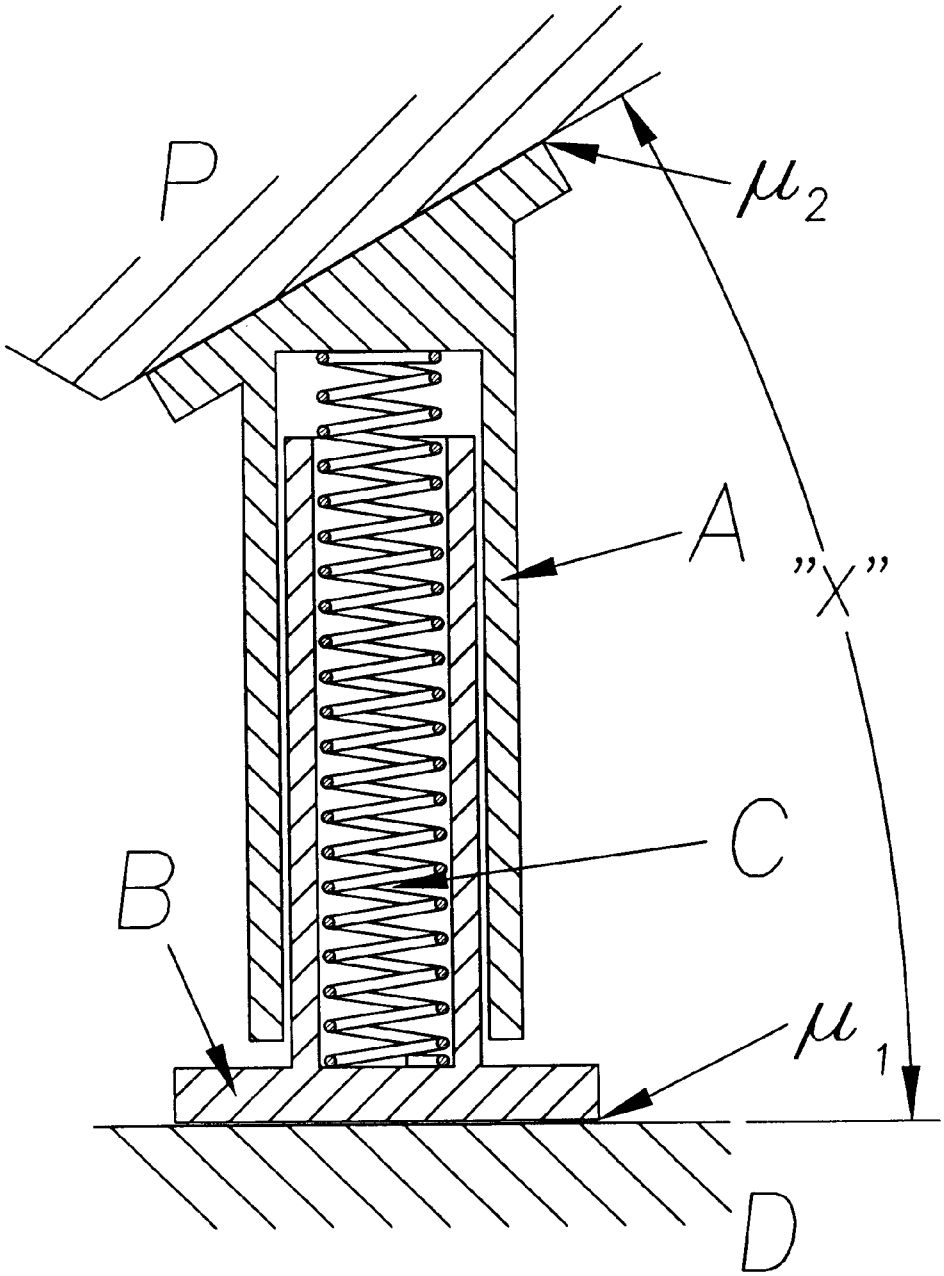
FIG. 9 is a schematic illustration of switch parts for exposition of operation of the quiet ratchet.

FIG. 9 is a schematic illustration useful for understanding how the angle of the driving face of the plunger teeth is derived. Although parts of the switch are identified in this sketch, they are merely schematic for purposes of exposition and do not correspond to the locations or shapes of the parts in an actual switch. In this sketch P represents the plunger with the driving face in contact with the ratchet A. The electrical contact cup is represented by B and it is in contact with an electrical terminal D. The spring C is for driving the mechanism. When the switch operates, the ratchet A slides along the driving face on a tooth of the plunger P, and the metal cup B slides along the terminal D, moving to the right in this sketch. In a switch, the contact portion of the cup engages a terminal pad intermittently as the switch goes between ON and OFF. Friction between the cup and terminal occurs when the switch is ON and that is what is used for determining angle.

The angle between the plunger and a plane normal to the longitudinal direction of the plunger is represented by X. The coefficient of friction between the plunger and ratchet is represented by $\mu_2$ and the coefficient of friction between the metal contacts is represented by $\mu_1$. No distinction need be made between the static coefficient and dynamic coefficient, either may be used. Static coefficient is preferred, or the dynamic coefficient if it is larger.

In an exemplary switch the material used for both the plunger and ratchet is an acetal plastic. Thus, an exemplary coefficient of friction for this interface is about 0.10. If nylon is used for one or both of these parts, a somewhat lower coefficient may be found. An exemplary coefficient of friction for the metal to metal (copper) contacts is about 0.16. Other values may be found when there is a soft metal such as silver, tin or cadmium on one of the surfaces, as compared with hard copper alloy. Since the angle of the teeth on the plunger depends on the friction, different materials than in an exemplary switch may result in different angles.

Coefficient of friction is defined as the tangent of the angle of repose, i.e., the ramp angle at which an object on the ramp would be at the borderline of sliding down. A steeper ramp indicates a higher coefficient of friction. A steeper ramp having a given coefficient also results in a sliding object moving more rapidly as it descends the ramp. It is generally true, and is assumed herein, that the friction between surfaces is independent of the area of contact. Also, the coefficient is largely independent of the normal force between the surfaces.

To move the ratchet, friction between the plunger teeth and ratchet and friction between the electrical contacts must be overcome (ignoring for the moment other friction in the switch). Thus, to move the parts in this sketch to the right, the angle X should be equal to $\tan^{-1}\mu_1+\tan^{-1}\mu_2$ or $X=\arctan\mu_1+\arctan\mu_2$.

In a switch, however, the sliding pattern is circular and $\mu_1$ and $\mu_2$ operate at different radial distances $R_1$ and $R_2$ respectively. The effective coefficient of friction of the electrical contacts takes this radial distance into account. Taking this into account, the formula becomes $$X=\arctan(\mu_1 \times R_1/R_2)+\arctan \mu_2$$

In an exemplary switch, the average radius to the electrical contacts is about 0.12 inch and the average radius to the teeth on the plunger is about 0.094 inch. Using these values and this second relationship and assuming that the coefficients of friction mentioned above for the plastic-plastic interface and the metal-metal interface are correct, it is found that the minimum angle for the plunger teeth is about 17.2 degrees.

$$X=\arctan(0.16\times(0.12/0.094)+\arctan 0.01$$

or $$X=11.5+5.7=17.2 \text{ degrees.}$$

There are other sources of friction in the switch, too, but they are relatively minor compared with these two, being for example, less than 5% of the total. For example, there is friction between the cup and ratchet. Assuming that this additional coefficient of friction is $\mu_3$ the equation becomes $$X=\arctan(\mu_1 \times R_1/R_2)+\arctan \mu_2+\arctan(\mu_3 \times R_3/R_2)$$

where $R_3$ is the effective radial distance to where A drives B. Clearly other frictional sources may be included in the same way. In actual switches there is friction between guiding and centering members acting on the moving parts, and sometimes radial contact forces. An additional force resisting motion may occur when electrical contact is just beginning, as there may be a slight "uphill" movement of the contact cup.

Rather than try to compute the angles precisely based on all the sources of friction, and recognizing that over the lifetime of a switch in service, the friction may increase 30 to 40% because of wear, wear particles and extraneous dirt, it is preferred to simply apply a margin of safety beyond the angle calculated for the principal sources of friction. This is sufficient to provide a switch with long term reliability. For example, in the exemplary switch, a safety margin of about six degrees was added to provide an angle on the plunger teeth of about 23°.

In a typical prior art switch, the plunger teeth are often arbitrarily formed at an angle of about 45°, or sometimes lower angles are seen. Thus, the angle is approximately cut in half.

The angle on the other face of the teeth, is simply whatever is needed to extend between peak and valley. The angle of the driving face of the plunger teeth and the circumferential extent of the teeth determine the "height" of the peak. The other face angle is then determined by that height and the resulting circumferential extent to make 45° (or other angle if there is a different number of teeth). In the exemplary switch described and illustrated, the angle of the other face of the teeth is about 21°.

This reduction in the angle of the driving face of the plunger teeth makes a much quieter switch, soft in both sound and touch. When the teeth are steep, the ratchet is driven to rotate at a relatively high speed, just as a skier descends more rapidly on a steeper slope. A sound or "click" is produced when the ratchet reaches the end of its travel for that cycle of operation, when the ratchet tooth impacts the change in slope on the plunger tooth. By reducing the angle on the driving teeth on the plunger, the ratchet is slowed and the impact force, hence the noise, is much reduced. The feel of the switch is also reduced as the "click" decreases.

Furthermore, the lowered angle on the driving face means that the total tooth height is less and the angle on the other face of each plunger tooth is commensurately lower. This slows the second half of the ratchet cycle, and sound and touch are decreased on the plunger return stroke, too.

This change to a quieter switch can be made by changing only the angle on the plunger teeth. It is not necessary that the angle of the ratchet teeth correspond to the plunger teeth. In prior switches the two sets of teeth have arbitrarily been made at about the same angle. That practice may be continued, but it is not necessary.

In the exemplary switch, the angle selected is about 23°. The maximum angle for the plunger teeth is up to about 30° so as to reduce the sound by more than about 50%. The kinetic energy imparted to the rotating ratchet is approximately proportional to the tangent of the angle on the plunger teeth. That kinetic energy is dissipated when the ratchet stops moving upon coming to the end of the teeth, i.e., in the valley at the end of the driving face. The kinetic energy is dissipated largely by creating sound upon impact at the end of travel. The lower tooth angle reduces sound by two effects.

The kinetic energy is decreased since the longitudinal distance of travel along the driving face of the plunger tooth is decreased. For an angle of 30°, this decrease is about 42% as compared with a tooth angle of 45°. Although this is nominally less than 50%, there is additional reduction in sound due to the second effect.

With a lower tooth angle, the impact distance is increased, permitting more of the kinetic energy to be dissipated by friction and significantly reducing the peak sound. When the teeth are at 45° the ratchet, in effect, comes to an instantaneous stop and a substantial "click" results. When the tooth angle is less than about 30°, the ratchet can climb the opposite face of the plunger tooth a short distance and then return to the valley instead of stopping rapidly. This not only reduces the total kinetic energy dissipated as sound, but also spreads the dissipation over a longer period of time so that the peak magnitude of the sound is substantially reduced. Thus, there is more of a "squish" than a "click" and both the aural and tactile impressions of switch actuation are reduced.

Preferably the maximum angle of the driving face is up to about 27°. When the angle is almost 27° the kinetic energy that may be dissipated by impact at the end of travel is about 50% of the amount for a face at an angle of 45°. This is regardless of the second effect of spreading the dissipation over a longer time for reducing peak sound.

When considered broadly as a ratchet, it will be noted that a quiet ratchet mechanism could have fewer teeth on the plunger than on the ratchet, as few as a single tooth. Conversely, there could be fewer teeth on the ratchet than on the plunger, again as few as a single tooth. One or the other of these parts has to have a number of teeth around the circumference so as to rotate the ratchet appropriately. In the described switch embodiment there are preferably a plurality of teeth on both the plunger and ratchet.

As a matter of convenience in the claims, a tooth at a selected angle is recited on the plunger and a plurality of teeth is recited on the ratchet. It should be understood that the converse with one tooth on the ratchet and a plurality of teeth on the plunger is equivalent and included within the scope of the claims. Similarly, the low angle on the tooth (or teeth) on the plunger to make the switch quieter could also be on the ratchet tooth (or teeth) and should be considered equivalent. The "driving face" could then be considered as a "driven face". To recite all of these equivalent variations in separate claims would unduly multiply the number of claims without changing the scope of coverage.

It so happens that in the embodiment described, the plunger and ratchet teeth have different shapes. These shapes could be more similar, so that the low angle is present on both sets of teeth. Other structural equivalencies should be recognized.

What is claimed is:

1. A pushbutton switch comprising:

a body including a barrel;

a plunger longitudinally movable in the barrel;

a ratchet coaxial with the plunger including a plurality of longitudinally extending camming teeth; and at least one longitudinally extending camming tooth on the plunger for engagement with the camming teeth on the ratchet, such a plunger tooth including a driving face having an angle from a normal to the longitudinal direction of the plunger wherein the angle is in the range of from the arctangent of the coefficient of friction between the ratchet teeth and the plunger tooth plus the arctangent of the effective coefficient of friction between other parts moved by depressing the plunger, to about 30 degrees.

2. A pushbutton switch according to claim 1 wherein the angle is at least equal to the arctangent of the coefficient of friction between the ratchet teeth and the plunger tooth plus the arctangent of the effective coefficient of friction between electrical contacts in the switch.

3. A pushbutton switch according to claim 1 wherein the angle is the arctangent of the coefficient of friction between the ratchet teeth and the plunger tooth plus the arctangent of the effective coefficient of friction between electrical contacts in the switch, plus a margin of safety greater than the arctangent of the effective coefficient of friction between other parts of the switch.

4. A pushbutton switch according to claim 1 wherein the driving face has an angle up to about 27 degrees.

5. A pushbutton switch comprising:

a body including a barrel;

a plunger longitudinally movable in the barrel;

a ratchet coaxial with the plunger including a plurality of longitudinally extending camming teeth; and at least one longitudinally extending camming tooth on the plunger for engagement with camming teeth on the ratchet, such a plunger tooth including a driving face having an angle from a normal to the longitudinal direction of the plunger wherein the angle is close to the sum of the arctangent of the coefficient of friction between the ratchet teeth and the plunger tooth and the arctangent of the effective coefficient of friction of other sliding surfaces.

6. A pushbutton switch according to claim 5 wherein the angle is at least equal to the arctangent of the coefficient of friction between the ratchet teeth and the plunger tooth plus the arctangent of the effective coefficient of friction between electrical contacts in the switch.

7. A pushbutton switch according to claim 6 wherein the driving face has an angle up to about 30 degrees.

8. A pushbutton switch according to claim 5 wherein the angle is the arctangent of the coefficient of friction between the ratchet teeth and the plunger tooth plus the arctangent of the effective coefficient of friction between electrical contacts in the switch, plus a margin of safety greater than the arctangent of the effective coefficient of friction between other parts of the switch moved by the plunger.

9. A pushbutton switch according to claim 8 wherein the driving face has an angle up to about 30 degrees.

10. A pushbutton switch according to claim 8 wherein the driving face has an angle up to about 27 degrees.

11. A pushbutton switch according to claim 5 wherein the driving face has an angle up to about 30 degrees.

12. A pushbutton switch according to claim 5 wherein the driving face has an angle up to about 27 degrees.

13. A pushbutton switch comprising:

a body including a barrel with longitudinally extending internal splines and ways between the splines;

a plunger longitudinally movable in the barrel and including radially extending lugs in the ways;

a ratchet coaxial with the plunger, having radially extending dogs which fit into the ways and including a plurality of longitudinally extending camming teeth;

a fixed electrical terminal member;

a rotatable electrical contact member connected to the ratchet for making or breaking contact with the fixed electrical terminal member; and at least one longitudinally extending camming tooth on the plunger for engagement with camming teeth on the ratchet, such a plunger tooth including a driving face having an angle from a normal to the longitudinal direction of the plunger wherein the angle is in the range of from the arctangent of the coefficient of friction between the ratchet teeth and the plunger tooth plus the arctangent of the effective coefficient of friction between other parts moved by depressing the plunger, to about 30 degrees.

14. A pushbutton switch according to claim 13 wherein the angle is at least equal to the arctangent of the coefficient of friction between the ratchet teeth and the plunger tooth plus the arctangent of the effective coefficient of friction between electrical contacts in the switch.

15. A pushbutton switch according to claim 13 wherein the angle is the arctangent of the coefficient of friction between the ratchet teeth and the plunger tooth plus the arctangent of the effective coefficient of friction between electrical contacts in the switch, plus a margin of safety greater than the arctangent of the effective coefficient of friction between other parts of the switch.

16. A pushbutton switch according to claim 15 wherein the driving face has an angle up to about 30 degrees.

17. A pushbutton switch according to claim 15 wherein the driving face has an angle up to about 27 degrees.

18. A pushbutton switch according to claim 13 wherein the driving face has an angle up to about 30 degrees.

19. A pushbutton switch according to claim 13 wherein the driving face has an angle up to about 27 degrees.

20. A pushbutton switch comprising:

a body including a barrel;

a plunger longitudinally movable in the barrel;

a ratchet coaxial with the plunger including a plurality of longitudinally extending camming teeth; and at least one longitudinally extending camming tooth on the plunger for engagement with camming teeth on the ratchet, such a plunger tooth including a driving face having an angle from a normal to the longitudinal direction of the plunger up to about 30 degrees.

21. A pushbutton switch according to claim 20 wherein the driving face has an angle up to about 27 degrees.

22. A pushbutton switch comprising:

a body including a barrel with longitudinally extending internal splines and ways between the splines;

a plunger longitudinally movable in the barrel and including radially extending lugs in the ways;

a ratchet coaxial with the plunger, having radially extending dogs which fit into the ways and including a plurality of longitudinally extending camming teeth;

a fixed electrical terminal member;

a rotatable electrical contact member connected to the ratchet for making or breaking contact with the fixed electrical terminal; and at least one longitudinally extending camming tooth on the plunger for engagement with camming teeth on the ratchet, such a plunger tooth including a driving face having an angle from a normal to the longitudinal direction of the plunger up to about 30 degrees.

23. A pushbutton switch according to claim 22 wherein the driving face has an angle up to about 27 degrees.

24. A ratchet mechanism comprising:

a plunger having at least one longitudinally extending tooth and constrained to translational motion and not rotational motion, each tooth having a driving face and an opposite face; and a ratchet member having a plurality of longitudinally extending teeth for engaging a tooth on the plunger and movable both in translation and in rotation; and characterized by the driving face on the plunger having an angle from a normal to the longitudinal direction of the plunger wherein the angle is in the range of from the arctangent of the coefficient of friction between the ratchet teeth and such a plunger tooth plus the arctangent of the effective coefficient of friction between other parts moved by depressing the plunger, to about 30 degrees.

25. A ratchet mechanism according to claim 24 wherein the driving face has an angle up to 27 degrees.

* * * * *